US005119655A

United States Patent [19]

Poloni

[11] Patent Number: 5,119,655

[45] Date of Patent: Jun. 9, 1992

[54] SPEED CONTROL METHOD AND SYSTEM FOR HIGH-SPEED ROLLING

[75] Inventor: Alfredo Poloni, Fogliano di Redipuglia, Italy

[73] Assignee: Danieli & C. Officine Meccaniche SpA, Buttrio, Italy

[21] Appl. No.: 544,915

[22] Filed: Jun. 28, 1990

[30] Foreign Application Priority Data

Jul. 10, 1989 [IT] Italy ..... 83454 A/89

[51] Int. Cl.[5] ..... B21B 1/18; B21B 37/00; B21B 13/12

[52] U.S. Cl. ..... 72/14; 72/201; 72/203; 72/235; 72/365.2

[58] Field of Search ..... 72/201, 235, 14, 203, 72/365.2, 366.2; 148/12 B

[56] References Cited

U.S. PATENT DOCUMENTS

| | | | |
|---|---|---|---|
| 3,314,264 | 4/1967 | Vater et al. | 72/443 |
| 3,518,859 | 7/1970 | Brinkeborn et al. | 72/443 |
| 4,162,624 | 7/1979 | Morooka et al. | 72/8 |
| 4,527,408 | 7/1985 | Jalil | 72/201 |
| 4,569,023 | 2/1986 | Wakamiya | 72/201 |
| 4,625,532 | 12/1986 | Economopoulos et al. | 72/201 |
| 4,889,567 | 12/1987 | Fujiwara et al. | 148/12 B |
| 4,909,058 | 3/1990 | Bindernagel et al. | 148/12 B |
| 5,060,499 | 10/1991 | Poloni | 72/235 |

FOREIGN PATENT DOCUMENTS

| | | | |
|---|---|---|---|
| 3039101 | 5/1982 | Fed. Rep. of Germany | 72/201 |
| 3730745 | 11/1988 | Fed. Rep. of Germany . | |
| 2459085 | 9/1981 | France . | |
| 0001154 | 7/1978 | Japan . | |
| 0107723 | 6/1984 | Japan . | |
| 0193709 | 11/1984 | Japan . | |
| 0061111 | 4/1985 | Japan . | |

OTHER PUBLICATIONS

Iron and Steel Engineer Article Entitled "Posco No. 3 wire rod mill-A state of the art rolling mill for the quality market", Roy et al., Jan. 1991, pp. 35-38.

*Primary Examiner*—Lowell A. Larson
*Assistant Examiner*—Thomas C. Schoeffler
*Attorney, Agent, or Firm*—Antonelli, Terry, Stout & Kraus

[57] ABSTRACT

Method and system for high-speed rolling at about 120 to 140 meters per second and more for rolled stock having a round section and a diameter of 5.5 to 6.5/7 mm. or equivalent, the high-speed rolling being carried out with a system comprising at least one rolling assembly (11) and a coil-forming headstock (12), the rolling assembly (11) including a plurality of pairs of rolls with their axes placed alternately at about 90° to each other, the speeds of the pairs of rolls being strictly correlated and controlled, the system being pre-arranged, before arrival of the rolled stock, for a rolling speed between 40 and about 100 meters per second and advantageously between 60 and 80 meters per second, this rolling speed being maintained at least until the leading end of the rolled stock has entered the coil-forming headstock (12), after which in at least one ramp of increase the rolling speed is brought up to 120 to 140 meters per second and kept at that level during the whole period of rolling of that specific section, the speed being reduced to the first starting speed in the transient moment of arrival of the next specific section.

14 Claims, 1 Drawing Sheet

SPEED CONTROL METHOD AND SYSTEM FOR HIGH-SPEED ROLLING

This invention concerns a method to start up high-speed rolling and also a relative system for high-speed rolling.

By high-speed rolling is meant rolling which, at the last rolling stand, travels at a speed of 120 to 140 meters per second or more in the case of round sections having a diameter of 5.5 to 6.5/7 mm. or equivalent.

The invention is applied to the employment of so-called high-speed blocks, that is to say, rolling stands comprising pairs of rolls with their axes placed alternately at about 90° to each other.

These high-speed blocks may have a common shaft to transmit motion to the individual pairs of rolls or may have pairs of rolls powered individually but conjunctly constrained electronically or mechanically.

The present applicant is not aware of methods or systems for high-speed rolling up to 120 to 140 meters per second or more.

The present applicant has found that, when rolled stock travels at such speed, all the operations downstream become difficult and have an uncertain outcome.

For instance, when the rolled stock enters a cooling chamber which is working, the rolled stock in fact encounters a wall of water and cannot pass.

Moreover, at this speed it is very hard to align the rolled stock with any inlet conduit and, besides, a positioning which is even slightly out of alignment becomes a source of considerable difficulties and problems, with resulting jamming.

By means of this invention the present applicant has overcome the problems of the state of the art and is therefore able to achieve high-speed rolling even with systems which are in fact normal or largely normal.

The invention is set forth and characterized in the main claims, while the dependent claims describe variants of the idea of the solution.

The invention will now be disclosed and described by making use of the attached figures, which are given as a non-restrictive example.

Figure 1:
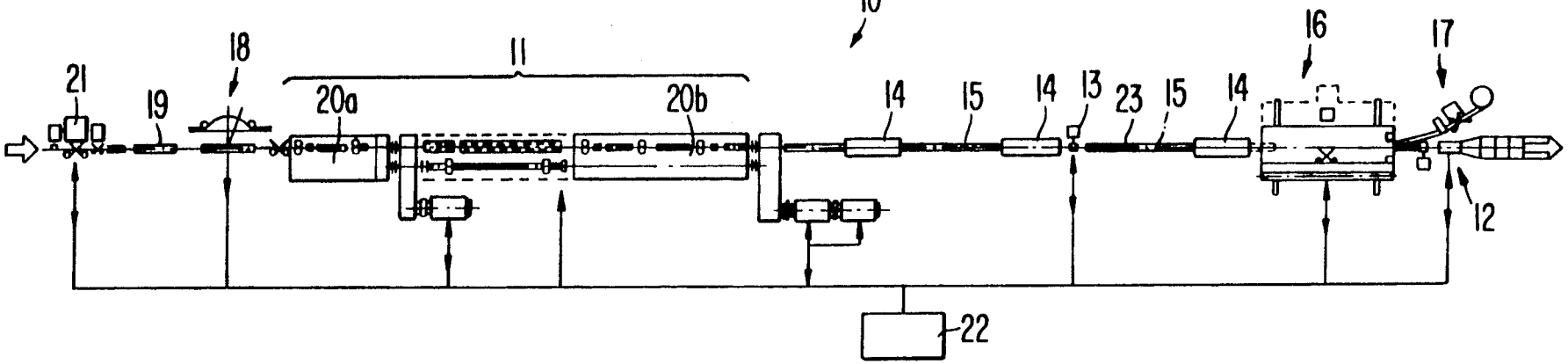
Figure 2C:
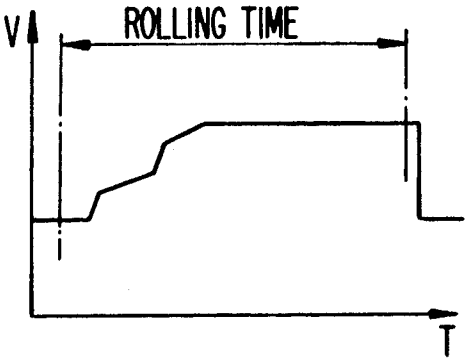
Figure 2B:
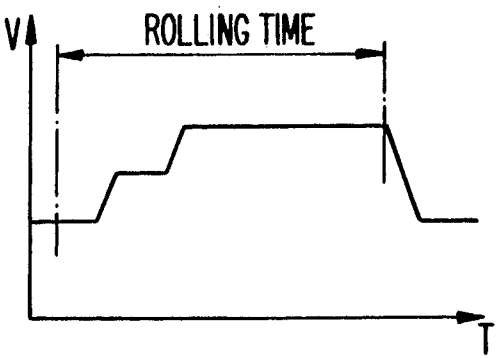
Figure 2A:
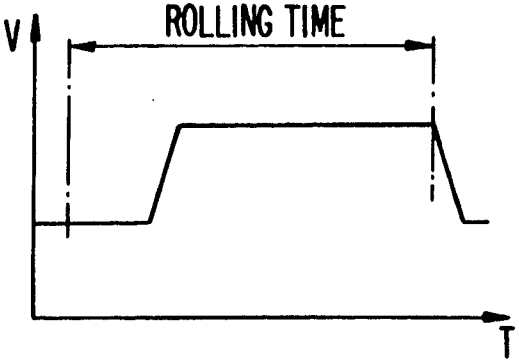

FIG. 1 shows a system according to the invention, while FIGS. 2*a*, 2*b* and 2*c* show three possible examples of an increase in speed.

According to the invention a system 10 consisting of at least one high-speed rolling block 11 and a coil-forming headstock 12 starts the rolling (FIG. 2*a*) at a medium speed of a normal type between 60 and 100 meters per second and advantageously between 60 and 80 meters per second.

When the leading end of a rolled product has entered the coil-forming headstock, the rolling speed is increased quickly within a period of time between two and about ten seconds and is brought up to the required value of 120 to 140 meters per second or more, and this speed is then maintained for the whole time needed to roll that specific section.

When that specific section has been completed and while the next section is arriving, the whole system is brought back to the initial speed of between 60 and 100 meters per second (FIG. 2*a*).

According to a variant the initial rolling speed can be even lower, between 40 and 60 meters per second, and the time required to reach the normal rolling speed may be between four and twenty seconds.

According to a further variant (FIGS. 2*b* and 2*c*) the passage from the initial rolling speed to the normal rolling speed may take place in two or more steps, and, when a step is reached, the system may maintain a settled speed for a preset period or may increase the speed slowly for a preset period before reaching the next step.

Moreover, according to yet another variant the increase in speed can take place with a plurality of micro-degrees of increase, which may also be differentiated from each other, in the transient period between the initial speed and the normal rolling speed.

According to a variant the system 10 includes between the coil-forming headstock 12 and the rolling block 11 a plurality of cooling chambers 14 spaced apart by temperature equalization chambers 15.

Chambers for homogeneous reduction of temperature with a last temperature equalization segment may be provided instead of the cooling chambers 14 spaced apart by temperature equalization chambers 15.

With given types of steel alloys or when the initial speed is high, the present applicant has found that it is necessary to include in an intermediate position between the rolling block 11 and coil-forming headstock 12 an intermediate drawing means 13 which keeps the rolled stock under traction in the zone upstream and reduces the combined bending and compression stress on the rolled stock.

According to another variant a shears unit 16 to crop the leading and trailing ends of the rolled stock and a possible scrap removal unit 17 are comprised immediately upstream of the coil-forming headstock 12.

In another variant the system 10 comprises a cropping shears 21 and possible scrap removal unit upstream of the rolling block 11. A cooling chamber 19 and possible loop control unit 18 may be included downstream of the cropping shears 21.

According to the invention the rolling block 11 will advantageously be of the type disclosed, shown and claimed in the parallel twin application Ser. No. 545,630, now U.S. Pat. No. 5,060,499, in the name of the same applicant and in the name of the same inventor; the contents of this parallel twin application are to be understood as being comprised herein.

In the case shown the high-speed rolling assembly 11 is included in two segments 20*a* and 20*b* with their own motors; the common shafts transmitting the motion in these segments are connected mechanically by an intermediate shaft which may possibly be capable of being divided momentarily.

According to the invention all the motors are governed by a control and actuation system 22, which may also be possibly connected to sensors and monitors performing control and verification functions.

This control and actuation system 22 governs in a coordinated manner the various motors and, as soon as it receives a signal that the rolled product is present in a stable manner in the coil-forming headstock 12, actuates with a required law the passage from a low initial rolling speed to the high rolling speed.

According to the invention a rolling line 23 extending from the rolling assembly 11 to the inlet of the coil-forming headstock 12 lies on a precisely controlled and maintained straight line.

I claim:

1. Method for high-speed rolling at 120 meters per second or more for rolled stock having a round section and a diameter of 5.5 to 7 mm, the high-speed rolling being carried out with a system comprising at least one rolling assembly and a coil-forming headstock, the rolling assembly including a plurality of pairs of rolls with the axes placed alternately at about 90° to each other, speeds of the pairs of rolls being strictly correlated and controlled, the method being characterized in that the system is prearranged, before arrival of the rolled stock, for a low rolling speed between 40 and about 100 meters per second, this low rolling speed being maintained at least until a leading end of one specific section of the roller stock has entered the coil-forming headstock, after with in at least one ramp of increase rolling speed is brought up to a high rolling speed of 120 meters per second or more and kept at the high rolling speed during a whole period of rolling of that one specific section, rolling speed being reduced to the low rolling speed in a transient moment of arrival of a next specific section.

2. Method as claimed in claim 1, in which the ramp of increase from the low rolling speed to the high rolling speed is included between two and twenty seconds.

3. Method as claimed in claim 1, wherein a rolling speed between 60 and 80 meters per second is maintained at least until the leading end of the rolled stock has entered the coil-forming headstock.

4. Method as claimed in claim 1, wherein each section of rolled stock is cooled at a position between said rolling assembly and said coil-forming headstock.

5. Method as claimed in claim 1, wherein said high rolling speed is 120 to 140 meters per second.

6. System for high-speed rolling of round sections having a diameter of 5.5 to 7 mm. at 120 meters per second or more comprising at least one rolling assembly and a coil-forming headstock, the rolling assembly including a plurality of pairs of rolls with their axes placed alternately at about 90° to each other, speeds of the pairs of rolls being strictly correlated and controlled, in which system motors are governed, controlled and actuated by a control and actuation system, which comprises sensors and monitors to perform control and verification, the system being characterized in that the control and actuation system starts the rolling at a low speed of between 40 and 100 meters per second and, when the rolled stock has entered the coil-forming headstock, raises the rolling speed to a maximum speed of 120 meters per second or more.

7. System as claimed in claim 6, which comprises an intermediate drawing means located between the rolling assembly and coil-forming headstock, the intermediate drawing means keeping under traction the rolled stock upstream.

8. System as claimed in claim 6, in which means to cool and to provide temperature equalization for the rolled stock are included between the rolling assembly and the coil-forming headstock.

9. System as claimed in claim 6, in which a shears to crop the leading and trailing ends of the rolled stock and a scrap removal unit are included upstream of the coil-forming headstock.

10. System as claimed in claim 6, in which a cropping shears and scrap removal unit are included upstream of the rolling assembly.

11. System as claimed in claim 6, in which a loop control unit is included immediately upstream of the rolling assembly.

12. System as claimed in claim 10, in which cooling means and temperature equalization means are included between the cropping shears and the rolling assembly.

13. System as claimed in claim 6, wherein said low speed is between 60 and 80 meters per second.

14. System as claimed in claim 6, wherein said maximum speed is 120 to 140 meters per second.

* * * * *